United States Patent [19]

Freeman et al.

[11] 4,263,688

[45] Apr. 28, 1981

[54] TOP AND BOTTOM DIE ASSEMBLIES FOR FOLDING THE EDGES OF A NON-RIGID WORKPIECE

[75] Inventors: D. Bruce Freeman; Michael C. Patton, both of Cincinnati; Carl F. Dragan, Harrison, all of Ohio

[73] Assignee: Louis G. Freeman Company, Erlanger, Ky.

[21] Appl. No.: 22,606

[22] Filed: Mar. 21, 1979

[51] Int. Cl.[3] ..... A43D 11/00; C14B 1/00; B65H 45/00

[52] U.S. Cl. ..... 12/55; 12/146 CK; 69/1; 493/379; 493/456; 493/472

[58] Field of Search ..... 12/55, 146 CK; 69/1; 270/93, 61 R, 66, 83

[56] References Cited

U.S. PATENT DOCUMENTS

| | | | |
|---|---|---|---|
| 1,946,999 | 2/1934 | Balsam | 69/1 |
| 3,024,019 | 3/1962 | Ladenburger | 270/61 R |
| 3,073,141 | 1/1963 | Freeman, Jr. | 12/55 X |
| 3,382,687 | 5/1968 | Freeman, Jr. | 69/1 |
| 3,753,831 | 8/1973 | Copithorne | 69/1 X |
| 3,823,935 | 7/1974 | Guichard | 270/61 R |
| 4,051,569 | 10/1977 | Freeman et al. | 69/1 X |

*Primary Examiner*—James Kee Chi

[57] ABSTRACT

Cooperating top and bottom die assemblies for use in a press to fold the edges of a non-rigid workpiece. The top die comprises a horizontal support plate having a radiused folding plate affixed to its underside. A spring biased stripper in association with the support plate is shiftable vertically relative thereto between a retracted position and a normal extended position below the radiused folding plate. The top die assembly support plate has a plurality of upstanding support posts on its upper surface together with means to affix the top die assembly to the upper platen of the press with the free ends of the upstanding support posts in abutment thereagainst. The bottom die assembly comprises a horizontal base plate adapted to rest on the bottom platen of the press. The base plate has a first set of downwardly depending hollow posts mounted on its underside to either side of the press bottom platen. This first set of posts is adapted to telescopically receive spring biased pins attached to a horizontal floating plate located above the base plate and shiftable by the top die assembly relative to the base plate between a normal position and a depressed position. The floating plate carries a male plug on its upper surface. The base plate has a second set of downwardly depending hollow post mounted on its underside to either side of the press bottom platen and adapted to telescopically receive spring biased pins attached to a horizontal cavity plate located above the floating plate. The cavity plate has a female cavity formed therein of such size and shape as to receive the male plug with close tolerance. The cavity plate is shiftable by the top die assembly relative to the base plate and the floating plate between a normal position and a depressed position.

36 Claims, 20 Drawing Figures

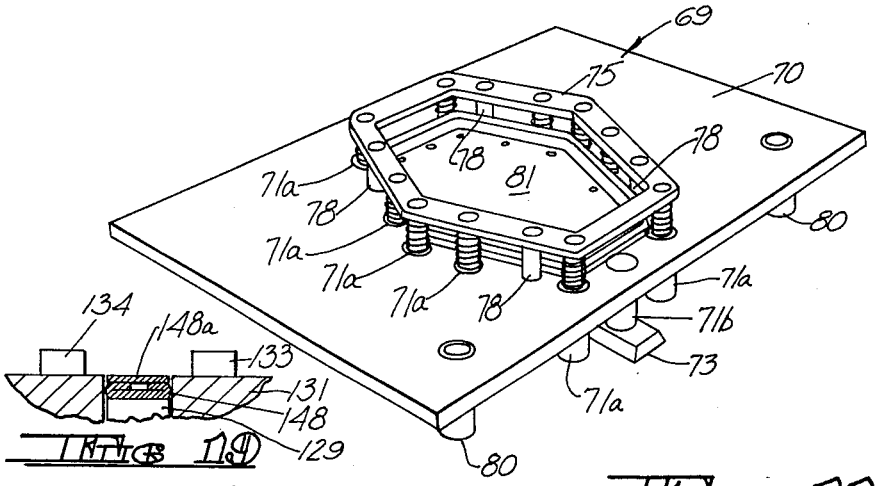
FIG. 11
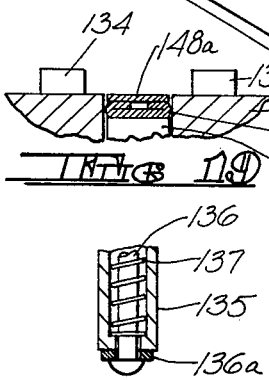
FIG. 19
FIG. 20
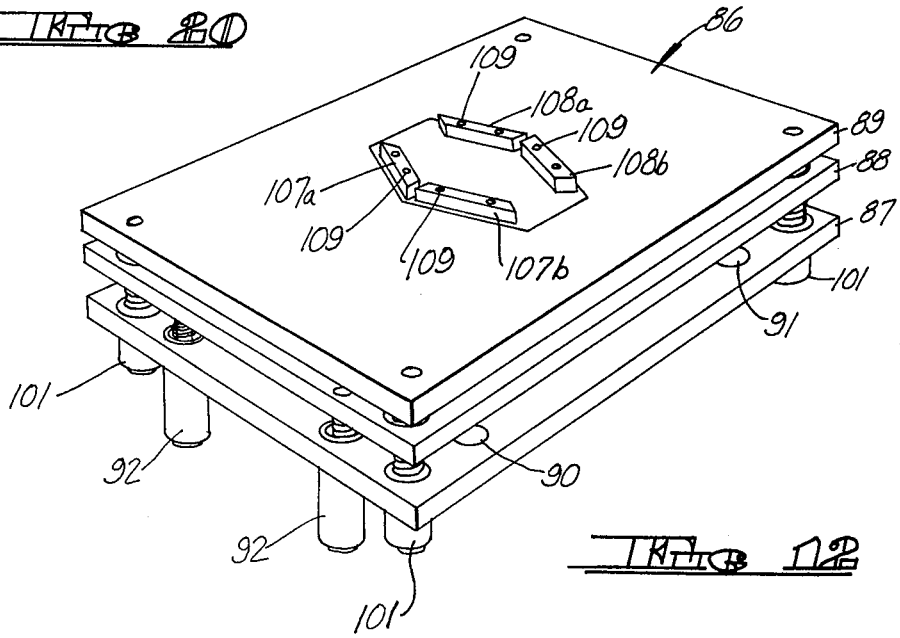
FIG. 12

TOP AND BOTTOM DIE ASSEMBLIES FOR FOLDING THE EDGES OF A NON-RIGID WORKPIECE

TECHNICAL FIELD

The invention relates to cooperating top and bottom die assemblies for folding the edges of a non-rigid workpiece, and more particularly to such top and bottom die assemblies which are lighter in weight and of simplified construction.

BACKGROUND ART

The cooperating top and bottom die assemblies of the present invention have many applications and can be used whenever it is desired to fold one or more edges of a non-rigid workpiece. While not intended to be so limited, for purposes of an exemplary showing the present invention will be described in its application to the manufacture of parts for the shoe industry.

It is usual practice in the manufacture of shoes to fold some at least of the edges of the individual parts making up the shoe upper so that they present finished edges. The edges of the workpiece to be folded are generally coated with a rubber base adhesive or the like so that they become temporarily bonded after the folding step. Thereafter, the folded edges are additionally stitched together. Alternatively, the edges may be coated with a permanent adhesive and the stitching step eliminated. The various types of adhesive used by the industry are well known and do not constitute a part of the present invention. They may be contact adhesives, heat reactive adhesives or the like.

Heretofore, prior art workers have provided cooperating top and bottom die assemblies for folding the edges of parts such as shoe vamps and the like. Exemplary top and bottom die assemblies are taught, for example, in U.S. Pat. Nos. 3,073,141 and 3,382,687. Such die assemblies performed well but were characterized by certain drawbacks. First of all, they were relatively heavy and complex in construction and, in order to complete a 180° fold in the workpiece edge, it was necessary to cycle the press once, shift a portion of the bottom die assembly, and then recycle the press.

Thereafter, prior art workers developed top and bottom die assemblies of such nature that the workpiece edges could be folded a full 180° with a single cycle of the press. A modified version of this type of top and bottom die assemblies is taught in U.S. Pat. No. 4,051,569. The top and bottom die assemblies of the last mentioned patent differed from the more usual type of such top and bottom dies assemblies in that the top die assembly had a stripper mounted on a floating plate independently operated by additional cylinders mounted on the press, rather than a stripper spring-mounted on the top plate of the top die assembly. This last mentioned patent also taught further modifications for the die assemblies whereby they could be used to seal the folded edges of the workpiece by means of high frequency electricity.

While top and bottom die assemblies of the type just discussed represented significant advances in the art, they two were characterized by certain deficiencies. First of all, the die assemblies were complex in construction and heavy, making handling of the top and bottom die assemblies during die assembly change-over more difficult. The top die, for example, required the presence of not only an intermediate floating plate to support the stripper, but also a top plate. Furthermore, the post and pin arrangement of the bottom die assembly frequently required that clearance holes be provided in one or more plates of the top die assembly to accommodate the pins of the bottom die assembly. This, among other things, limited the useful surface area of the top and bottom die assemblies.

The present invention is directed to improvements in the top and bottom die assemblies of the general type taught in the above mentioned U.S. Pat. No. 4,051,569. The die assemblies of the present invention are easier to manufacture, easier to service and lighter in weight, making them easier to handle during die assembly change-over. The post and pin arrangement of the bottom die assembly eliminates any need for clearance holes in the top die assembly for the pins of the bottom die assembly. This not only gives more working area on both die assemblies, but also eliminates the danger of having a portion of the operator's hands punctured or severed by the pins of the bottom die assembly, if his hands are inadvertently caught between the die assemblies. Furthermore, the post and pin arrangement of the bottom die assembly enables the provision of a deeper pocket (i.e. a thicker cavity plate) in a bottom die of preset overall dimensions. The normal position of the male plug of the bottom die assembly can readily be adjusted to accommodate for the application of a lining or the like to the workpiece, if desired.

The particular arrangement of posts on the top die assembly enables the elimination of a top plate and in many instances the elimination of an intermediate or floating plate as well. This greatly reduces the weight of the top die assembly.

The top and bottom die assemblies of the present invention provide fewer problems of alignment of parts. The die assemblies can readily be modified to apply heat to the folded edges of the workpiece, as will be described hereinafter. The construction of the top die assembly is such that it can readily accommodate a very thin, narrow stripper as will be shown.

In the normal use of such die assemblies, the stripper remains in contact with the workpiece throughout the folding procedure. There are instances, however, when it would be desirable to disengage the stripper from the workpiece during the final portion of the folding procedure. This is true, for instances, when the edges of a very narrow workpiece are being folded and the stripper would be in the way of the final folding step. It has also been found that when the die assemblies are used to apply heat to the workpiece edges, if the stripper remains in contact with the workpiece it will cause undesirable marking of the rear side of the workpiece or of the lining for the workpiece, if a lining is present.

The die assemblies of the present invention may readily be provided with means for causing the stripper to be disengaged from the workpiece during the final portion of the folding procedure and/or during the application of heat to the folded edges of the workpiece or to a lining being applied to the workpiece. These stripper disengagement means constitute parts of the die assemblies, themselves, and no additional cyliners, or the like, are required for the press. Finally, the die assemblies of the present invention can be both of the cavity and plug types, as will be described.

DISCLOSURE OF THE INVENTION

In accordance with the invention there is provided cooperating top and bottom die assemblies for use in a press to fold the edges of a non-rigid workpiece, the press being of the type having top and bottom platens.

The top die comprises a horizontal support plate having a radiused folding plate mounted on its underside. A spring biased stripper is provided in association with the support plate and is shiftable vertically relative to the support plate between a retracted position and a normal extended position below the radiused folding plate. The top die assembly support plate has a plurality of upstanding support post on its upper surface together with means to affix the top die assembly to the upper platen of the press with the free ends of the upstanding support posts in abutment thereagainst.

The bottom die assembly comprises a horizontal base plate adapted to rest upon the bottom platen of the press. A first set of downwardly depending, hollow posts are mounted on the underside of the base plate and are so positioned as to be located to either side of the press bottom platen. This first set of posts is adapted to telescopically receive spring biased pins attached to a horizontal floating plate located above the base plate. The horizontal floating plate is shiftable by the top assembly between a normal position and a depressed position, relative to the bottom die assembly base plate. A male plug is mounted on the upper surface of the floating plate. A second set of downwardly depending, hollow post are mounted on the underside of the bottom die assembly base plate to either side of the press bottom platen. This second set of post are adapted to telescopically receive spring biased pins attached to a horizontal cavity plate located above the floating plate. The cavity plate has a female cavity formed therein of a configuration identical to that of the folded workpiece and is adapted to receive the male plug with close tolerance. The cavity plate is shiftable relative to the base plate and the floating plate, by the top die assembly between a normal position and a depressed position.

The arrangement of posts on the top die support plate can be utilized to spring bias a floating plate to which the stripper is mounted, if required. The die assemblies may also be provided with means whereby they apply heat to the folded edges of the workpiece or heat to a lining to attach the lining to the folded edges of the workpiece. Finally, means may be provided on the die assemblies themselves to cause the stripper to be disengaged from the workpiece during the final portion of the folding operation and/or during application of heat to the folded edges or to a lining being attached to the folded edges.

BRIEF DESCRIPTION OF THE DRAWINGS

FIG. 11 is a bottom perspective view of of the top die assembly of FIG. 10.

FIG. 12 is a top perspective view of a bottom die assembly for use with the top die assembly of FIGS. 10 and 11.

FIG. 19 is a fragmentary view, partly in cross section, illustrating a workpiece and lining mounted on the male plug of FIG. 16.

FIG. 20 is a fragmentary view, partly in cross section of a post and pin assembly of FIG. 16 provided with a spacing washer.

DETAILED DESCRIPTION OF THE INVENTION

Figure 1:
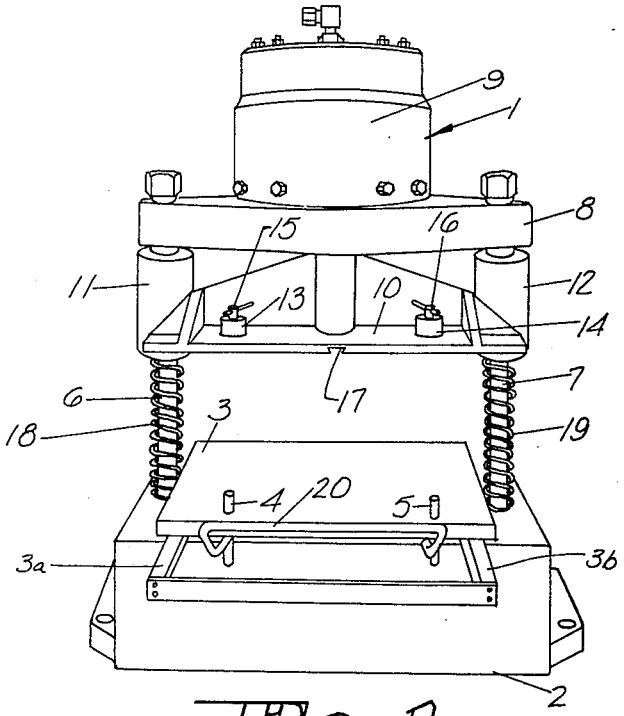
FIG. 1 is a perspective view of an exemplary press with which the top and bottom die assemblies of the present invention may be used.

For a better understanding of the present invention reference is first made to FIG. 1 wherein there is shown an exemplary press with which the top and bottom die assemblies of the instant invention can be used. The press is generally indicated at 1 and comprises a base 2 which supports a bottom platen 3. The bottom platen 3 has a pair of upstanding pins 4 and 5 on its upper surface which are adapted to enter cooperating holes in the base plate of the bottom die assembly to locate the bottom die assembly on the bottom platen 3.

A pair of posts 6 and 7 extend upwardly from base 2 in parallel spaced relationship. These posts support a cylinder mounting plate 8 to which a pneumatic cylinder 9 is affixed. The piston rod (not shown) of cylinder 9 is connected to a casting 10 comprising a horizontal top platen located beneath cylinder mounting plate 8. The top platen 10 has integral cylindrical guides 11 and 12 formed on either side thereof. Cylindrical guides 11 and 12 are provided with axial bores adapted to slidingly receive posts 6 and 7, respectively. The cylindrical guides 11 and 12, in cooperation with posts 6 and 7, maintain proper alignment of the upper platen 10. The upper surface of platen 10, near its forward edge, is provided with a pair of bosses 13 and 14. Each of the bosses 13 and 14 has an axial threaded bore therein which extends through the platen 10. Set screws 15 and 16 are threadedly engaged in the axial bores of bosses 13 and 14, respectively. The purpose of screws 15 and 16 will be described hereinafter. The bottom surface of platen 10 is provided with a central dovetail slot 17 which extends from its forward edge toward its rearward edge. The purpose of dovetail slot 17 will also be set forth hereafter.

Each of posts 6 and 7 carry compression springs 18 and 19 respectively. The lower end of spring 18 abuts the press base 2, while its upper end abuts the cylindrical guide 11. In similar fashion the lower end of spring 19 abuts the press base 2 while its upper end abuts cylindrical guide 12. Springs 18 and 19 serve (in addition to a spring within cylinder 9, not shown) as return means for the main cylinder and the upper platen 10 attached thereto, the main cylinder 9 being of the single acting type. When a 2-way cylinder is used, springs 18 and 19 can be eliminated.

The bottom platen 3 is mounted on the press base 2 by any appropriate means which enables the bottom platen to be shifted horizontally between a working position within the press and a bottom die assembly loading and unloading position wherein the platen 3 extends forwardly and partway out of the press. For purposes of an examplary showing the base 2 is illustrated as having a pair of rails **3*a* and 3*b*. The bottom platen 3 is provided with rollers (not shown) engaging the rails 3*a* and 3*b*. To assist in shifting the bottom platen 3 between its working position and its loading and unloading position, the bottom platen may be provided with a handle 20. It will be understood that the press 1** will have appropriate control means, actuating means and safety devices (not shown), all of which are well known in the art.

The die assemblies of the present invention may be used to fold many different types of products. As indicated above, for purposes of an exemplary showing, they will be described in terms of their application to the folding of workpieces constituting parts of a shoe upper. The top and bottom die assemblies are custom made to the extent that their various working parts will be appropriately configured to properly fold one or more edges of a particular shoe upper part having a desired configuration.

Figure 2:
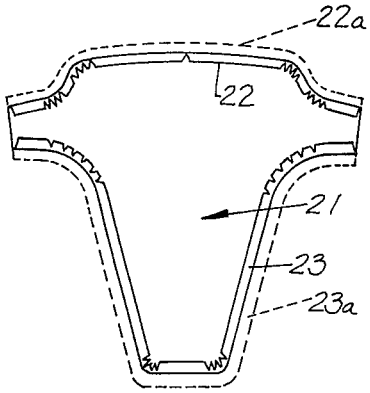
FIG. 2 is a bottom view of an exemplary workpiece in the form of a shoe vamp in folded condition, the unfolded configuration of the vamp being indicated in broken lines.
Figure 3:
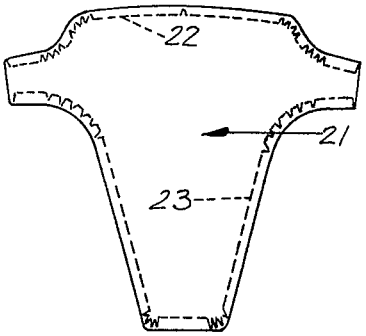
FIG. 3 is a top plan view of the vamp of FIG. 2.

By way of illustration only, an exemplary shoe part is shown in FIGS. 2 and 3 in the form of a shoe vamp. In FIGS. 2 and 3 like parts have been given like index numerals. The shoe vamp is generally indicated at 21. The vamp may be made of any appropriate non-rigid material such as leather or man-made material. In FIG. 2 the underside of the vamp is shown, illustrating its rearward edge 22 and its forward edge 23 in folded condition. The unfolded conditions of rearward edge 22 and forward edge 23 are shown in broken lines at **22*a* and 23*a*, respectively. Thus, these broken lines show the original, unfolded configuration of the vamp. FIG. 3 is a top or plan view of the folded vamp, its rear and forward folded edges 22 and 23** being shown in broken lines.

The vamp edges may be coated with a rubber base adhesive or the like to temporarily hold them in folded condition until stitched. Alternatively, the edge portions of the vamp may be coated with a contact-type adhesive which will maintain them permanently in folded condition, or they may be permanently sealed in folded condition through the use of a heat reactive adhesive, as will be described hereinafter.

Figure 4:
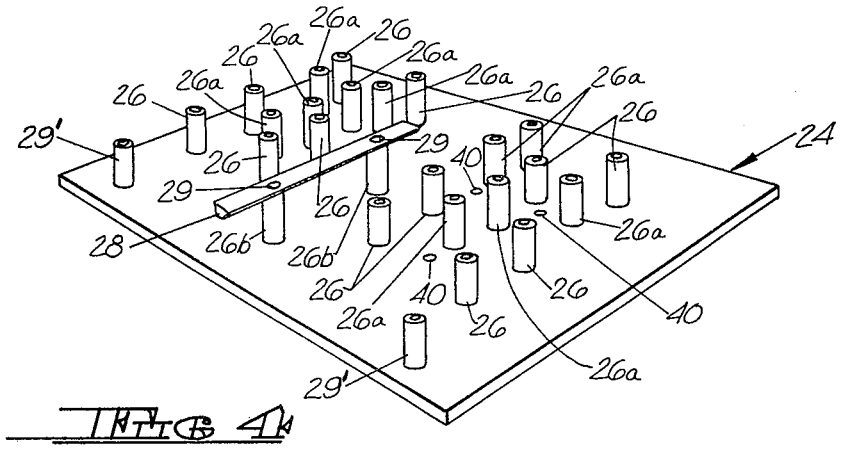
FIG. 4 is a top perspective view of a top die assembly of the present invention.
Figure 5:
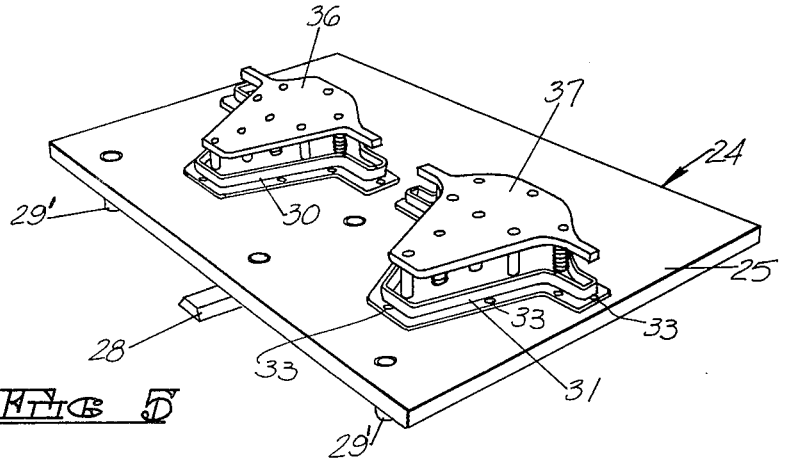
FIG. 5 is a bottom perspective view of the top die assembly of FIG. 4.
Figure 7:
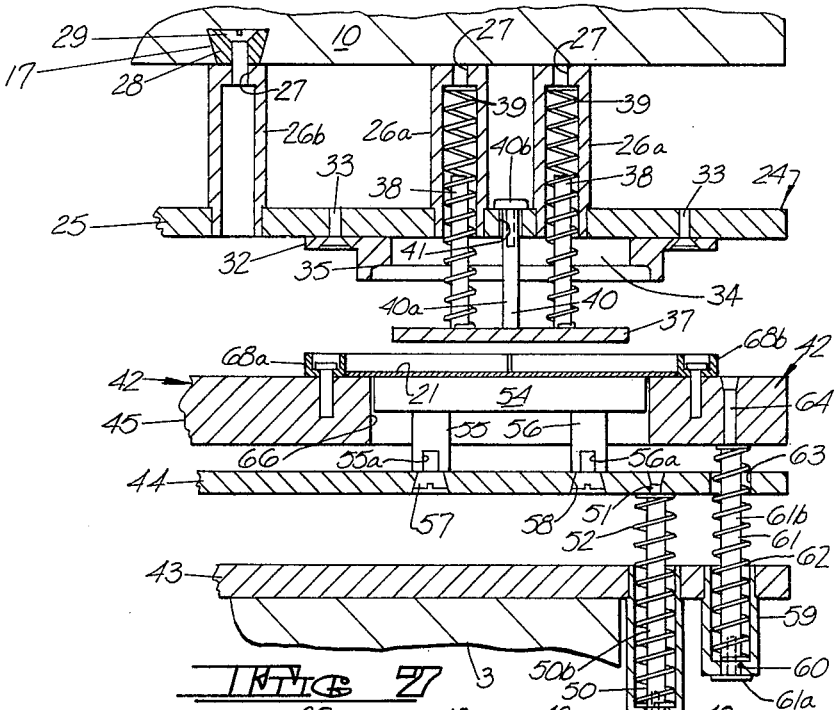
FIG. 7 is a fragmentary, semi-diagrammatic, cross sectional view illustrating the top and bottom die assemblies of FIGS. 4 through 6 mounted in a press and in their normal unactuated conditions.

Reference is now made to FIGS. 4, 5 and 7 wherein a top die assembly of the present invention is illustrated, the top die assembly having parts adapted to fold the edges of a vamp of the type shown in FIGS. 2 and 3. In FIGS. 4, 5 and 7 like parts have been given like index numerals. The top die assembly is generally indicated at 24 and comprises a horizontally oriented support plate 25. The upper side of the support plate, as shown in FIGS. 4 and 7, has a plurality of upstanding support posts 26 and **26*a* mounted thereon. The support posts 26 and 26*a* are identical. Their lowermost ends are open and may be affixed to support plate 25 in any appropriate way. As shown in FIG. 7, the support plate 25 may be provided with perforations to accommodate the support posts with a pressed and riveted fit. The support posts have closed upper ends. The enclosed upper ends may be provided with threaded perforations 27, the purpose of which will be described hereinafter. The number of support posts 26 and 26*a*** will depend upon the shape of the workpieces being folded. Their number must be such as to provide adequate and balanced support for the top die assembly, as can be readily determined by one skilled in the art.

In the center of support plate 25 there is a pair of posts **26*b*. These posts may be identical to support posts 26 and 26*a*, again being provided with a threaded perforation 27 in their upper ends, one of which is shown at 27 in FIG. 7. Posts 26*b* support a dovetailed gib 28 which is affixed to the posts 26*b* by screws 29 threadedly engaged in the threaded posts perforations 27. All of posts 26, 26*a* and 26*b* are of the same size. When the top die assembly 24 is to be attached to upper platen 10 of the press, the dovetailed gib 28 is caused to enter the dovetailed slot 17 of upper platen 10 and the upper die assembly is shoved rearwardly until the gib 28 bottoms against a pin (not shown) in the slot 17. It is also within the scope of the invention to provide stops for the die assembly 24 at the rear edge of upper platen 10. When the top die assembly 24 is so mounted on upper platen 10, all of the posts 26, 26*a* and 26*b* abut the underside of the platen and therefore fully support the support plate 24 of top die assembly 24 from the upper platen 10. Yet another pair of upstanding posts 29' are provided, extending upwardly from the upper surface of support plate 25 and being located in the forward corners of the support plate. These posts 29' are substantially identical to the support posts 26, 26*a* and 26*b*, being of the same height. They differ from these previously mentioned support posts in that they are open-ended at the top as well. When the upper die assembly is fully seated on the upper platen, the set screws 15 and 16 of the upper platen are turned downwardly so as to enter into the posts 29'. The set screws 15 and 16 assure, together with gib 28, proper alignment of the top die assembly 24** and they preclude shifting of the top die assembly with respect to the upper platen.

A pair of identical radiused folding plates 30 and 31 are mounted on the underside of support plate 25. Radiused folding plate 31 is shown in FIG. 7 and a description of this radius folding plate will also suffice as a description of radiused folding plate 30. The radiused folding plate 31 has a peripheral configuration similar in shape to that of the vamp of FIGS. 2 and 3. The radiused folding plate 31 has a peripheral flange 32 by which it is attached to the underside of support plate 25 by means of screws 33. The remainder of the radiused folding plate 31 extends downwardly from the underside of support plate 25 and has an exterior peripheral shape which is substantially identical to the peripheral shape of the unfolded vamp. The central portion of the radiused folding plate 31 is open and is defined by a vertical surface 34 which is similar in shape to the vamp but is dimensioned to be substantially equivalent to that portion of the vamp within the confines of its folded edges. The surface 34 has, adjacent it, a radiused folding surface 35, the dimensions and configuration of which is substantially identical to the peripheral dimensions and configuration of the folded vamp.

To complete the upper die 24 there are provided two identical strippers 36 and 37. A description of stripper 37 which is also shown in FIG. 7 will suffice to serve as a description of stripper 36. The stripper 37 is a planar element having a peripheral configuration so shaped and dimensioned as to be engagable with the vamp within the confines of its folded edges. Thus, the stripper is also just nicely receivable within the surface 34 defining the hollow central portion of the radiused folding plate 31. The stripper 37 has a plurality of upstanding pins riveted or otherwise permanently affixed to its upper surface. Two of these pins are shown at 38 in FIG. 7. The pins 38 are receivable within the hollow support posts 26*a*. It will be noted from FIG. 4 that the hollow support posts 26*a* differ from the support posts 26 only in that they overlie the stripper. Since there are, in the embodiment illustrated in FIG. 4, five posts 26*a* over each of strippers 36 and 37, it will be understood that each of the strippers 36 and 37 will have five of the pins 38 so located as to be receivable within the five posts 26*a*. Each of the pins 38 is surrounded by a compression spring 39. The lower end of each compression spring 39 abuts the upper surface of the stripper. The upper end of each compression spring 39 abuts the upper closed end of its respective hollow post 26*a*. In this way, the strippers 36 and 37 are spring biased to their normal extended position illustrated in FIGS. 5 and 7 wherein they lie below their respective radiused folding plates 30 and 31.

To determine the normal extended positions of strippers 36 and 37, each stripper is provided with a plurality of stripper height determining pins. Three such pins 40 are visible in FIG. 4 for stripper 37. It will be understood that the other stripper 36 also be provided with three such stripper height determining pins. One of the stripper height determining pins 40 for stripper 37 is shown in FIG. 7, it being understood that the other stripper height determining pins for this stripper are identical and work in an identical manner. The stripper height determining pin 40 comrpises a shank 40*a* having a screw mounted in its upper end providing a head 40*b*. The shank 40*a* extends through a perforation 41 in support plate 25 with clearance. The lowermost end of the pins shank 40*a* is affixed to the stripper 37 as by riveting or the like. It will thus be evident from FIG. 7 that the head 40*b* of pin 40 normally engages the upper surface of support plate 25 thereby determining the normal extended position of stripper 37.

Figure 6:
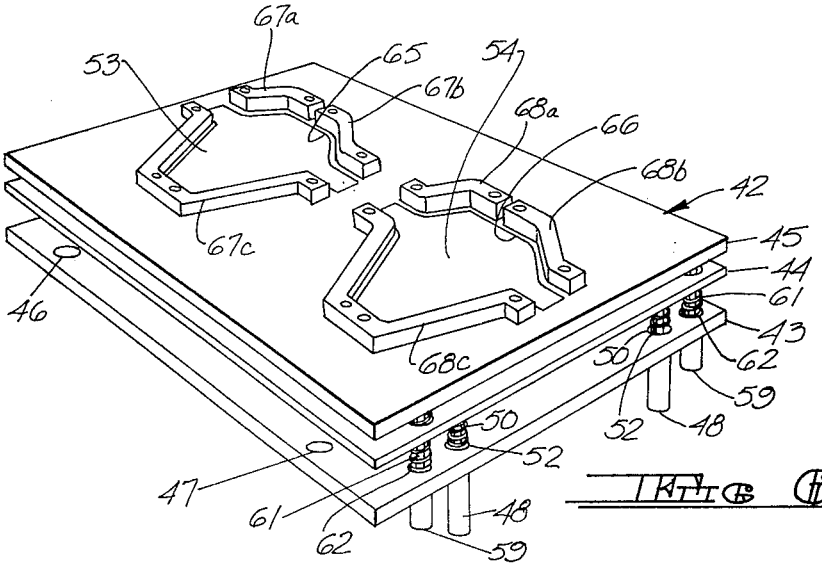
FIG. 6 is a top perspective view of a bottom die assembly for use with the top die assembly of FIGS. 4 and 5.

Reference is now made to FIGS. 6 and 7 wherein a bottom die assembly (generally indicated at 42) for use with top die assembly 24 is shown. Again like parts have been given like index numerals. The bottom die assembly comprises a base plate 43, an intermediate floating plate 44 and a cavity plate 45.

The base plate 43 is a planar member and has a pair of perforations 46 and 47 (see FIG. 6) at its front edge to receiving the locating pins 4 and 5, respectively on bottom platen 3 (see FIG. 1).

On its underside, the base plate 43 has two pairs of downwardly depending posts mounted thereon, one pair located at either side thereof. One such pair of posts is shown in FIG. 6 at 48. It will be understood that an identical pair of posts will be similarly located at the other side of base plate 43. The pairs of posts 48 are spaced from each other by a distance sufficient to enable them to lie to either side of the side edges of bottom platen 3 when the bottom die assembly is mounted thereon. The posts 48 are hollow, open at their upper ends and closed at their bottom ends, the bottom ends being provided with a central bore 49. Slidably mounted in the bore 49 there is a pin 50 having a head portion 50*a* comprising a screw mounted in the lower end of a shank portion 50*b*. The free end of shank portion 50*b* abuts the underside of floating plate 44 and is attached thereto by riveting as at 51 or by other appropriate means. The pin 50 carries a coil spring 52. The bottom end of coil spring 52 abuts the closed bottom end of post 48. The upper end of spring 52 abuts the underside of floating plate 44. Thus, the floating plate 44 is supported by four such assemblies near its side edges and has a normal upper position (illustrated in FIGS. 6 and 7) determined by the cooperation of coil springs 52 and the abutment of pin heads 50*a* against the bottom end of posts 48. As indicated above, the posts 48 are located near the side edges of base plate 43. In the semi-diagrammatic representations of FIGS. 7 through 9, the post 48 has been illustrated inset somewhat so that it would be visible in the drawings. The proper location for the posts 48 is shown in FIG. 6.

Floating plate 44 carries a pair of male plugs 53 and 54. The male plugs 53 and 54 are identical and have a peripheral configuration identical to that of the folded vamp illustrated in FIG. 3. The mounting of male plugs 53 and 54 to the floating plate 44 is identical and reference is again made to FIG. 7. The male plug 54 is provided with a plurality of downwardly depending posts, two of which are shown at 55 and 56. The upper ends of these posts may be affixed to the male plug in any appropriate manner. The lower ends of posts 55 and 56 are provided with threaded axial bores 55*a* and 56*a*, respectively. The bores 55*a* and 56*a* are threadedly engaged by screws 57 and 58 passing through floating plate 44.

The cavity plate 45 is mounted to base plate 43 in precisely the same manner as is floating plate 44. To this end, the base plate 43 is provided with a second set of pairs of posts 59 located near its side edges. One pair of the posts 59 is clearly illustrated in FIG. 6 and it will be understood that the other pair of posts 59 is similarly located at the other side of the base plate. One of the posts 59 is shown in FIG. 7. The post 59 is substantially identical to post 48 except that it is somewhat shorter. The closed lower end of post 59 is provided with a perforation 60. A pin 61, comprising a screw (forming head 61*a*) threaded into the bottom end of a shank 61*b*, is mounted in the post in the same manner described with respect to pin 50. The pin 61 is surrounded by a compression spring 62. It will be noted that a clearance hole 63 is provided in floating plate 44 to accommodate the pin 61 and compression spring 62. The upper end of pin 61 is affixed to cavity plate 45 in any appropriate manner, such as riveting or the like, as at 64. The upper end of compression spring 62 abuts the underside of cavity plate 45 while the lower end of compression spring 62 abuts the closed lower end of post 59. In this way, the cavity plate 42 is supported from the base plate 43 by four such post and pin assemblies in the same manner as is floating plate 44. The cavity plate 45 is provided with two female cavities 65 and 66 which are adapted to receive the male plugs 53 and 54, respectively, with close tolerance.

To finish the bottom die assembly, the female cavity plate supports a plurality of gauges surrounding female cavities 65 and 66. To this end, female cavity 65 is surrounded by gauge elements 67*a*, 67*b* and 67*c*. Similarly, female cavity 66 is surrounded by gauge elements 68*a*, 68*b* and 68*c*. The gauge elements are spaced from the edges of their respective female cavities by a distance such that they will receive the unfolded workpiece or vamp as shown in broken lines in FIG. 2 and will properly center the workpiece or vamp above its respective female cavity.

It will be evident from the description thus far that the top die assembly 24 and bottom die assembly 25 are so configured as to fold two workpieces or vamps of the type shown in FIGS. 2 and 3, simultaneously. The operation of the top and bottom die assemblies can readily be described with respect to FIGS. 7, 8 and 9. For purposes of simplicity, these Figures illustrate only a portion of the top and bottom die assemblies containing stripper 37, male plug 54 and female cavity 66, which cooperate to fold one of the workpieces or vamps. It will be understood that stripper 36, male plug 53 and female cavity 65 will function in an identical manner to fold the other of the two workpieces.

Turning first to FIG. 7, the parts of top die assembly 24 and bottom die assembly 42 are illustrated in their normal, at-rest positions. The press operator, using handle member 20 (FIG. 1) will shift the bottom die assembly to its forward or loading position and will place a vamp blank within the confines of each of the gauge sets 67*a* through 67*c l and 68a* through 68*c*. Then, the bottom die is returned to its retracted position within the press and, as is shown in FIG. 7, the vamp blank 21 will overlie cavity plate 42 within the confines of gauges 68*a* through 68*c*, also overlying male plug 54. At this point, the operator causes the press 1 to cycle.

Figure 8:
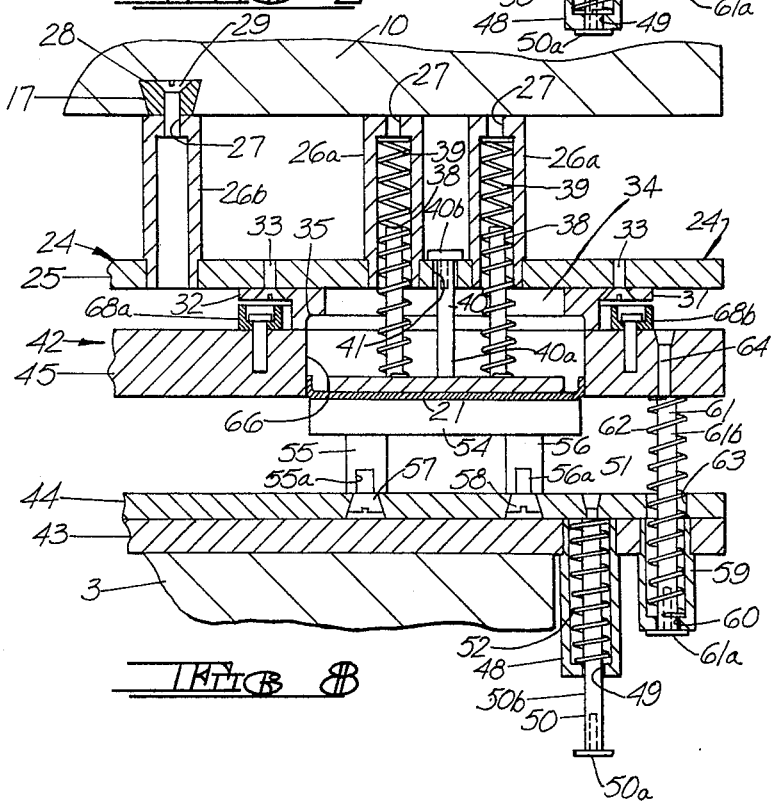
FIG. 8 is a fragmentary, semi-diagrammatic, cross sectional view of the die assemblies, similar to FIG. 7, and illustrating the relative positions of the die assemblies after having performed the initial 90° fold in the workpiece.

As the top platen 10 of the press and the top die assembly 24 attached thereto begin their downward movement, the stripper 37 will first contact the workpiece 21 and cause the workpiece to be engaged between the stripper 37 and the male plug 54. The compression springs 39 associated with the stripper 37 are selected to be stronger than the compression springs 52 associated with floating plate 44. As a result, continued downward movement of top die assembly 24 will result in a downward shifting of bottom die assembly floating plate 44 and the male plug 54 it supports. This continues until the bottom die assembly floating plate 44 abuts the bottom die assembly base plate 43, as shown in FIG. 8. At the point, male plug 54 has reached the bottom of female cavity 66 and the edges of workpiece 21 have been turned upwardly 90° as shown in FIG. 8. At the same time, the radiused folding plate 31 of top die assembly 24 has come into abutment with the upper surface of the bottom die assembly cavity plate 45, within the confines of the gauges 68*a* through 68*c*.

Figure 9:
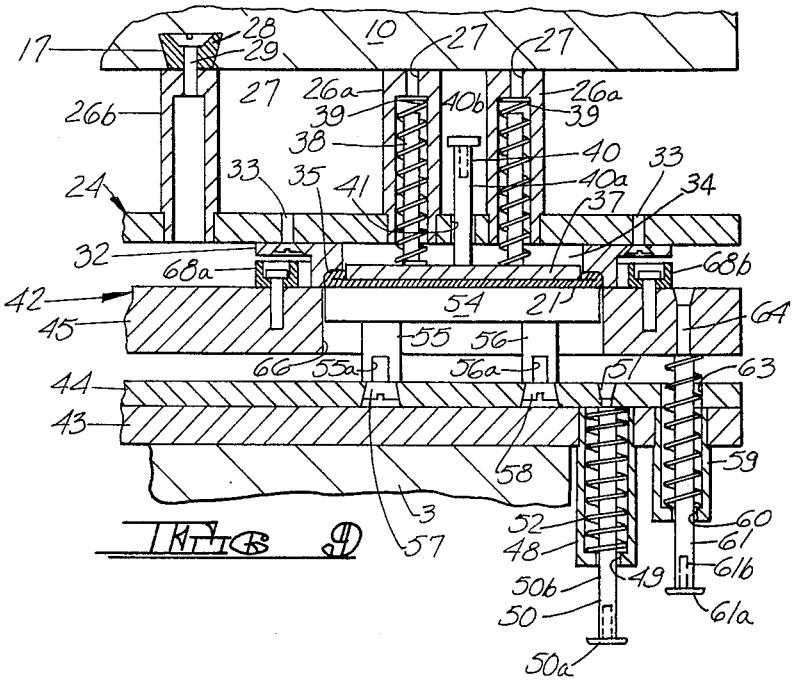
FIG. 9 is a fragmentary, semi-diagrammatic, cross sectional view of the die assemblies, similar to FIG. 7, and illustrating the relative positions of the die assemblies at the time the final 180° fold is made in the workpiece.

Continued downward movement of the press top platen 10 and top die assembly 24 will cause the cavity plate 45 of bottom die assembly 42 to shift downwardly. At the same time, since the stripper 37 is in abutment with male plug 54 with the workpiece therebetween and since the male plug is supported by the bottom die floating plate 44 which has bottomed against the bottom die base plate 43, the stripper will remain stationary against the action of its compression springs 39. As the upper surface of the cavity plate 45 approaches the top surface of the male plug 54, the upstanding partially folded edges of the workpiece or vamp 21 will enter the top die assembly radiused folding plate 31. The radiused folding plate 31 will result in completion of the 180° folding of the vamp edges, as shown in FIG. 9. At this point, the press completes its cycle by return of the top platen 10 and the top die assembly 24 attached thereto to their upper or normal positions. The operator can thereafter shift the bottom die assembly to its out-of-press, forward position and remove both of the folded workpieces or vamps therefrom, replacing them with vamp blanks. When the bottom die assembly 42 is returned to its in-press position, the cycle may be repeated.

Figure 10:
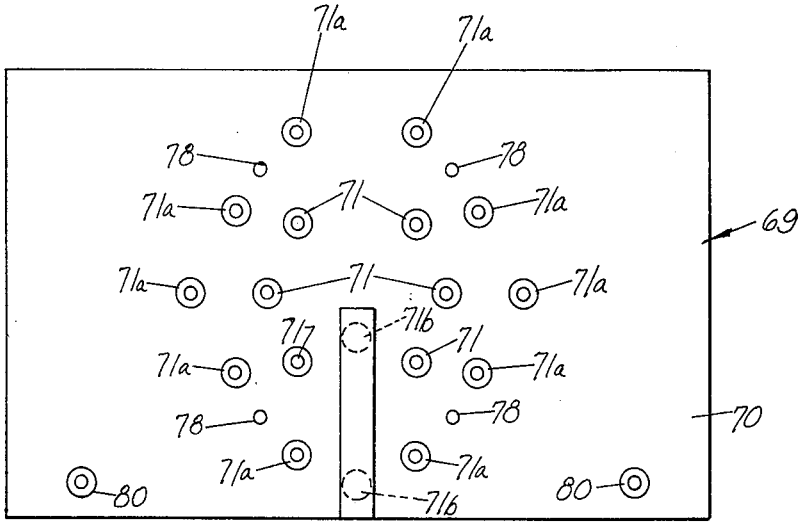
FIG. 10 is a top plan view of another embodiment of top die assembly of the present invention.
Figure 13:
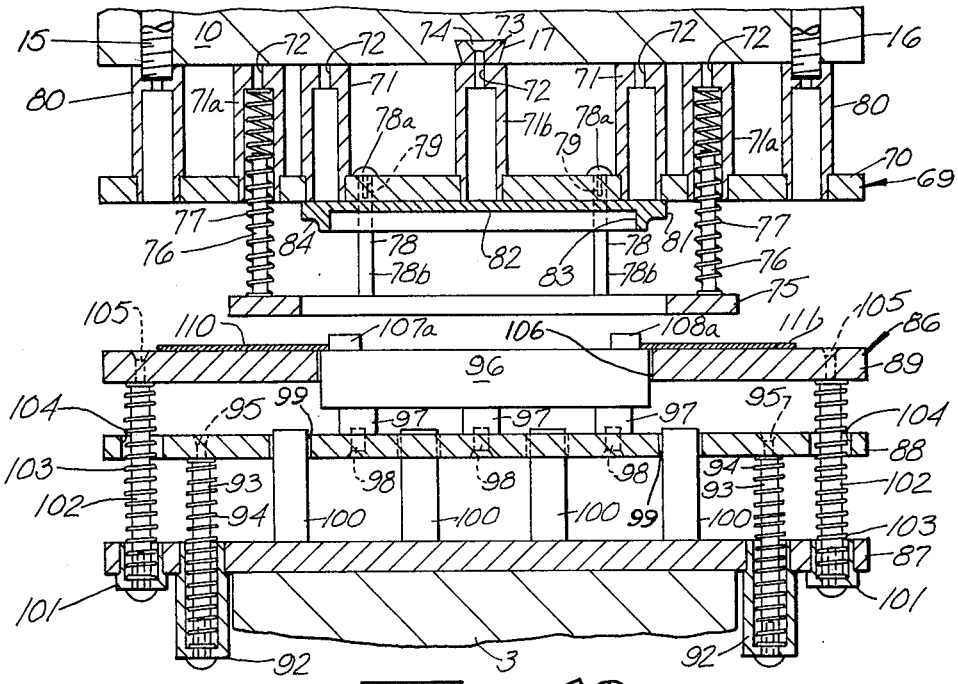
FIG. 13 is a fragmentary, semi-diagrammatic, cross sectional view of the top and bottom die assemblies of FIGS. 10, 11 and 12 mounted in a press and in their normal, unactuated condition.

The top and bottom die assemblies 24 and 42 are of the cavity type. The teachings of the present invention are equally applicable to die assemblies of the plug type. Plug type die assemblies are illustrated in FIGS. 10 through 13 wherein like parts have been given like index numerals. Reference is first made to FIGS. 10, 11 and 13 wherein the top die assembly is generally indicated at 69. FIG. 10 is a top plan view of the top die assembly 69. FIG. 11 is a perspective view of the underside of the top die assembly, while FIG. 13 is a semi-diagrammatic, cross sectional view thereof. The top die assembly 69 comprises a support plate 70 similar to support plate 25 of top die assembly 24, previously described. The support plate 70 has a plurality of upstanding posts 71, 71*a* and 71*b* mounted thereto. All of these posts are identical and may be interchangeable. They are all hollow, with an open lower end and closed upper end. Since they are interchangeable, the closed upper end of each of these posts may be provided with a threaded axial bore 72. Only the posts 71*b* utilize the threaded axial bore 72. These posts support a dovetailed gib 73 substantially identical to dovetailed gib 28 and adapted to be received within the dovetailed slot 17 of top press platen 10 (see FIG. 1). The dovetailed gib 73 is attached to the posts 71*b* by screws, one of which is shown at 74 in FIG. 13. When the top die assembly 69 is mounted on the top press platen 10, the upper ends of all of posts 71, 71*a* and 71*b* will be in abutment therewith, as was described with respect to the post 26, 26*a* and 26*b* of the top die assembly 24 of FIG. 4. The posts 71 serve simply as abutment means, as is true of the posts 26 of FIG. 4. The posts 71*a* overlie a stripper 75 and accommodate pins 76 riveted or otherwise affixed to the stripper 75 and surrounding compression springs 77. The pins 76 and compression springs 77 are equivalent to the top die assembly pins 38 and compression springs 39 shown in FIG. 7.

In FIGS. 11 and 13 the stripper 75 is illustrated in its extended or normal position. This position is determined by a plurality of stripper height determining pins 78. The pins 78 each comprise a screw (providing a head portion 78*a*) threaded into the upper end of a shank portion 78*b*. The lowermost ends of the shank portion 78*b* of pins 78 are riveted or otherwise affixed to the stripper 75. The shank portions 78b pass through clearance perforations 79 in support plate 70 with a sliding fit. Abutment of the head portions 78a of pins 78 against the upper surface of support plate 70 will determine the normal position of stripper 75.

Near its forward corners, the support plate 70 is provided with a pair of hollow, open ended posts 80. These posts serve the same purpose as posts 29 of top die assembly 24 of FIG. 4, cooperating with the set screws 15 and 16 of the top press platen 10.

Unlike the top die assembly 24 of FIGS. 4 and 5, the top die assembly 69 has a radiused folding plate 81 mounted on the underside of support plate 70 by screws 81a within the confines of stripper 75. The radiused folding plate 81 has a central depressed portion 82 defined by a vertical surface 83 of such dimensions as to receive the gauge members of the bottom die assembly, as will be evident hereinafter. In this embodiment, the radiused folding plate has an exterior radiused surface 84.

The bottom die assembly is generally indicated at 86 in FIGS. 12 and 13. The bottom die assembly once again comprises a base plate 87, a floating plate 88 and a cavity plate 89. The base plate 87 is provided near its forward edge with a pair of perforations 90 and 91 (see FIG. 12) adapted to receive the locating pins 4 and 5, respectively, of the bottom press platen 3 (see FIG. 1).

The base plate 87 is again provided with two pairs of downwardly depending posts 92 located to either side of the base plate and spaced from each other so that they will be located to either side of the press bottom platen 3 when the bottom die assembly 86 is mounted thereon. The posts 92 are identical to the posts 48 of FIG. 7 and slidably mount pins 93 and accommodate compression springs 94 equivalent to the pins 50 and compression springs 52 of FIG. 7. The upper ends of pins 93 are attached to floating plate 88 by riveting or the like, as at 95 and the pins 93 and compression springs 94 determine the normal upper position of floating plate 88 illustrated in FIGS. 12 and 13. The floating plate 88 supports a male plug 96. To this end, the male plug 96 has a plurality of posts 97 appropriately affixed to its underside. The posts 97 have their lower ends mounted on the upper surface of floating plate 88 by screws 98, or by other appropriate means. The floating plate 88 also has a plurality of clearance holes 99 formed therein to accommodate a series of identical upstanding posts 100 mounted on base plate 87 and serving as stop means for cavity plate 89, as will be described hereinafter.

Base plate 86 is provided with a second set of pairs of downwardly depending posts 101 similar to but shorter than the posts 92. Each post 101 is essentially identical to the post 59 of FIG. 7 and to this end slidingly accommodates a headed pin 102 and a compression spring 103 similar to pin 61 and compression spring 62. Clearance holes 104 are provided in floating plate 88 for the pins 102 and compression springs 103. The uppermost ends of pins 102 are affixed to the underside of cavity plate 89 by riveting or the like as at 105. It will be understood that the two pair of posts 101, pin 102 and spring 103 assemblies will be located to either side of the base plate 87 in the same manner described with respect to posts 59 in FIG. 6. In in the semidiagrammatic representations of FIGS. 13 through 15, the posts 92 are shown inset from the side edges of base plate 87, but this is done simply so that both the posts 92 and 101 can be shown in the semi-diagrammatic representations at the same time.

The cavity plate 89 of bottom die assembly 86 is shown in FIGS. 12 and 13 in its normal, upper position as determined by the compression spring 103 and the abutment of the heads of pins 102 against the bottom ends of their respectived posts 101. The cavity plate 89 has a female cavity 106 formed therein to receive male plug 96 with close tolerance.

To complete the bottom die structure, two sets of gauges 107a–107b and 108a–108b are affixed to the upper surface of male plug 96 by screws 109 or other appropriate means. Each set of gauges 107a–107b and 108a–108b cooperates with its own workpiece so that the top and bottom die assemblies 69 and 86 are adapted to fold two workpieces simultaneously. The sets of gauges are inset from the adjacent edges of male plug 96 by an amount equivalent to the edge to be folded over on each of the workpieces.

Figure 14:
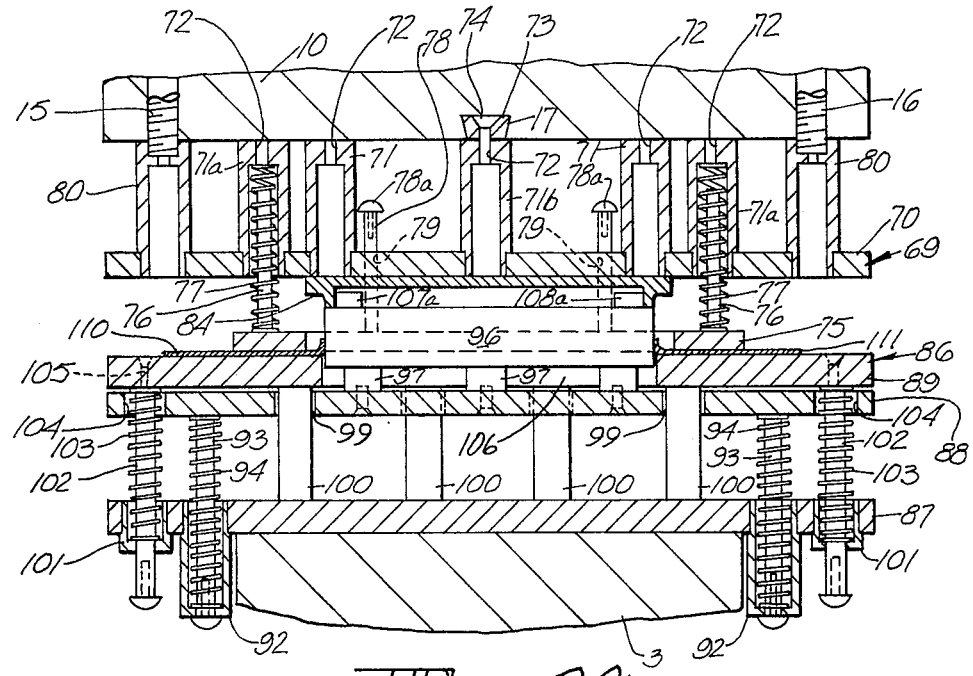
FIG. 14 is a fragmentary, semi-diagrammatic, cross sectional view similar to FIG. 13 and illustrating the top and bottom die assemblies thereof in their relative positions after having performed the initial 90° fold in the workpiece.
Figure 15:
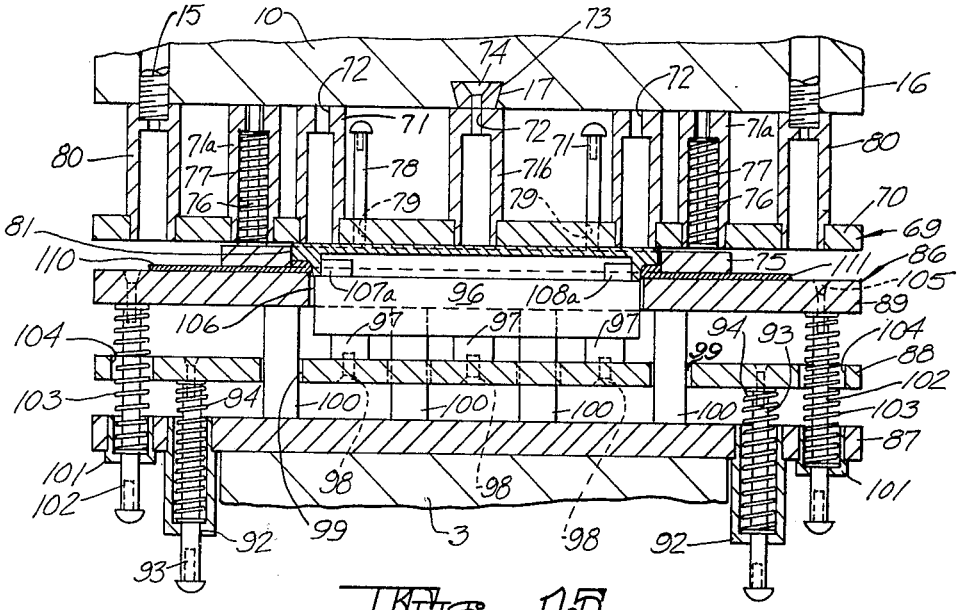
FIG. 15 is a fragmentary, semi-diagrammatic, cross sectional view similar to FIG. 12 and illustrating the top and bottom die assemblies thereof in their relative positions at the time the final 180° fold is made in the workpiece.

The operation of top and bottom die assemblies 69 and 89 may be described with reference to the semidiagrammatic representations of FIGS. 13 through 15. Referring to FIG. 13 first, the top and bottom die assemblies 69 and 86 are shown in the normal, unactuated positions. The bottom die assembly 86 may be shifted out from beneath the press to its forwardmost position by the operator, utilizing the handle 20 on the bottom platen 3 (see FIG. 1). In this workpiece-loading position, the bottom die assembly 86 is ready to have the operator place a pair of workpieces 110 and 111 on the cavity plate 89 and in position against the sets of gauges 107a–107b and 108a–108b, as shown in FIG. 13. The bottom die assembly 86 is then returned to its in-press, working position. At this point, the operator initiates the press cycle.

As the top press platen 10 and the top die assembly 69 begin to move downwardly, the stripper 75 will first contact the workpieces 110 and 111. Continued downward movement of top die assembly 69 will cause the cavity plate 89 to shift downwardly until it abuts the post-like stops 100. This is shown in FIG. 14. The compression springs 77 of the stripper 75 are chosen to be stronger than the compression springs 103 of cavity plate 89. As the cavity plate 89 shifts downwardly, the initial 90° bend will be made in the edges of workpieces 110 and 111, as shown in FIG. 14. As the cavity plate 89 bottoms against the post-like stops 100, the upper surface of male plug 96 will also be contacted by radiused folding plate 81.

As the top die assembly 69 continues its downward travel, the radiused folding plate 81 will cause the male plug 96 and the floating plate 88 to which it is attached to shift downwardly against the action of compression springs 94. This will continue until the full 180° fold is made in the workpieces 110 and 111. At this point, the stripper 75 will bottom against its support plate 70 and it will be remembered that the bottom die assembly cavity plate 89 has already bottomed against the post-like stops 100. The folds in workpieces 110 and 111 having been completed, the press returns to its open condition completing the cycle. The bottom die assembly 86 may be withdrawn from beneath the press by means of the forward sliding bottom press platen 3 so that the workpieces 110 and 111 can be removed from the bottom die and new workpiece blanks substituted for them.

Figure 16:
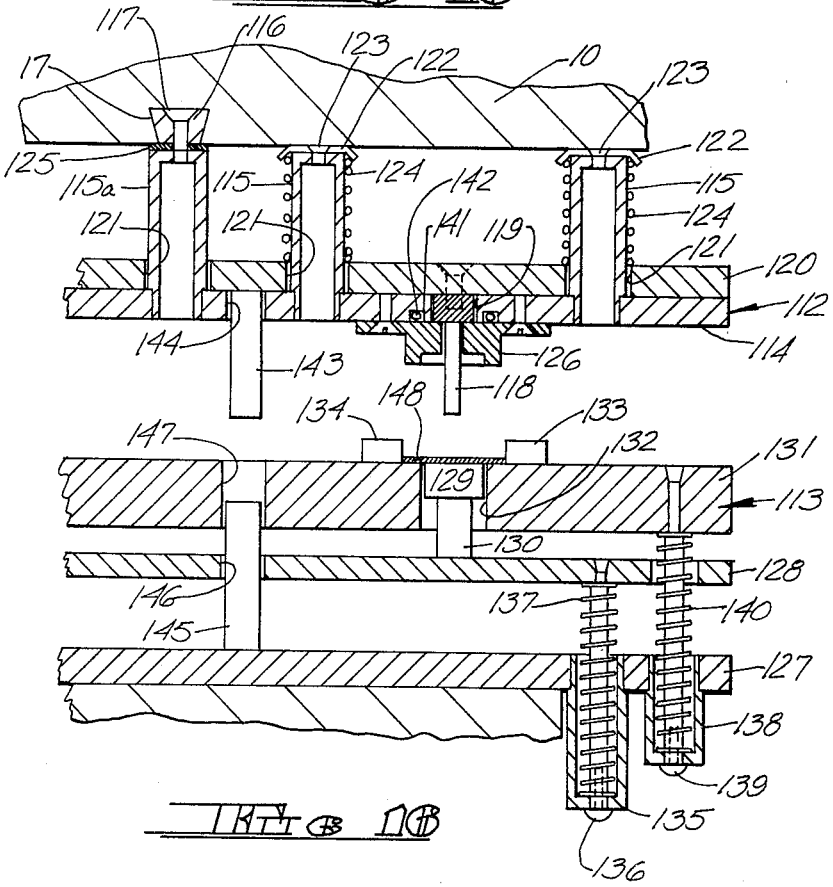
FIGS. 16 through 18 are fragmentary, semi-diagrammatic cross sectional views similar to FIGS. 7, 8 and 9, respectively, illustrating modifications of the top and bottom die assemblies of the present invention.
Figure 17:
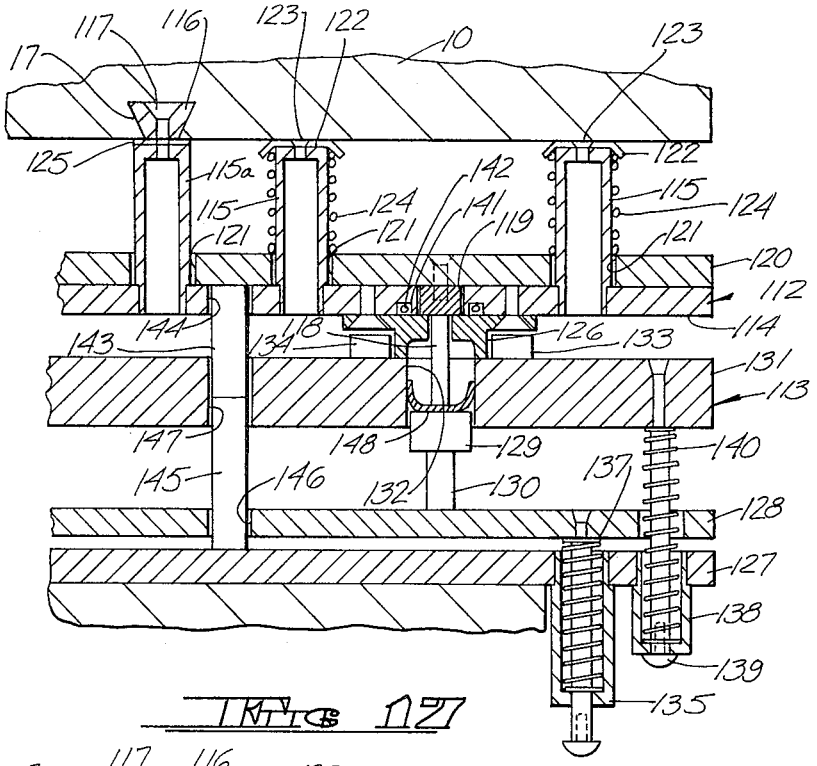
Figure 18:
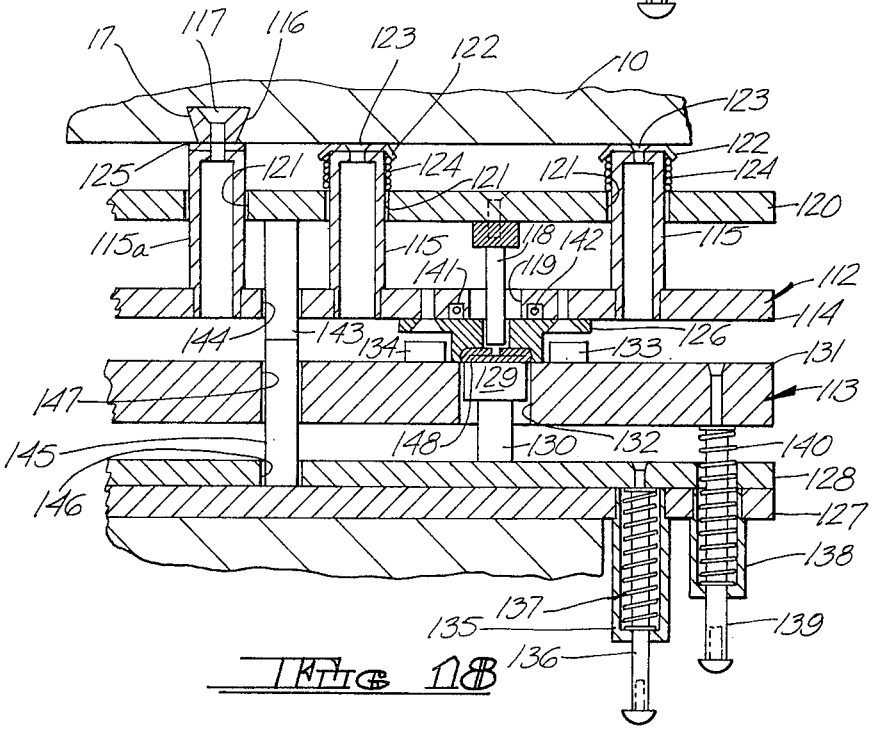

Reference is now made to FIGS. 16 through 18 wherein like parts have been given like index numerals. There are instances where the stripper is sufficently narrow that is cannot be spring mounted utilizing the post and pin arrangement taught with respect to the embodiment of FIGS. 4 through 9 or the embodiment taught with respect to FIGS. 10 through 15. To illustrate this, FIG. 16 shows a top die assembly generally indicated at 112 and a bottom die assembly generally indicated at 113. The top and bottom die assemblies 112 and 113 are of the cavity type and are similar to the embodiment shown in FIGS. 4 through 9. To this end, the top die assembly 112 has a support plate 114 having a series of hollow upstanding posts 115 and 115*a* mounted thereon. The posts 115 are equivalent to posts 26 and 26*a* in FIG. 4. There will be two posts 115*a* (only one of which is shown). These posts are equivalent to the posts 26*b* of FIG. 4 and are intended to support a dovetail gib 116 mounted thereon by screws, one of which is shown at 117. The dovetailed gib is adapted to be received in the dovetailed slot 17 of the press top platen 10 in the same manner described with respect to FIGS. 4 through 9. Top die assembly 112 will also be provided with posts (not shown) equivalent to posts 29 in FIG. 4, serving the same purpose.

In the embodiment of FIG. 16 a thin, narrow stripper 118 is provided. This stripper passes through an appropriately configured opening 119 in support plate 14. The stripper 118 has an enlarged upper portion 118*a* which is affixed to the underside of a floating plate 120 by screws (one of which is shown at 118*b*). The floating plate 120 is provided with a plurality of clearance holes 121 to accommodate for posts 115 and 115*a* as well as the posts (not shown) equivalent to posts 29 of FIG. 4. In this way, the floating plate 120 and the stripper 118 mounted thereto are shiftable relative to support plate 114.

Selected ones of posts 115 are provided at their upper ends with cap-like spring retainers 122 affixed thereto by screws 123. These posts support compression springs 124. The lowermost ends of compression springs 124 abut floating plate 120, while the upper ends of the springs about the spring retainers 122. Thus, the springs 124 bias the floating plate and the attached stripper 118 to their normal lowermost position with the floating plate 120 in abutment with the support plate 114. The spring retainers 122 abut the underside of upper press platen 10 so that the posts 115 fully support the plate 114, as is true in the embodiment of FIGS. 4 through 9. The number of posts 115 provided will depend upon the nature of the top die assembly 112 and its strippers 118. The number of posts 115 provided with spring retainers 122 and compression springs 124 will again depend upon the nature of the top die assembly 112 to assure proper functioning of stripper 118. Any posts 115 not provided with a compression spring 124 and spring retainer 122, as well as posts 115*a*, will be provided with a spacer to accommodate for the thickness of the spring retainers 122. Such a spacer is shown on post 115*a* at 125. To completed the top die assembly 112, the underside of support plate 114 has a radiused folding plate 126 similar to radiused folding plates 30 and 31 of the embodiment of FIGS. 4 through 9 and appropriately configured for the workpiece being folded.

The bottom die assembly 113 is essentially identical to the bottom die assembly illustrated in FIGS. 6 and 7. To this end, the bottom die assembly comprises a base plate 127, a floating plate 128 supporting male plugs (one of which is shown at 129) by means of appropriate supports or posts (one of which is shown at 130) and a cavity plate 131 having a female cavity 132 formed therein (for each male plug) and supporting gauges 133 and 134 on its uppermost surface. The floating plate 128 is supported by two pairs of assemblies, each assembly comprising a post 135, a pin 136 and a compression spring 137 equivalent to post 38, pin 50 and compression spring 52 of FIG. 7. In similar fashion, cavity plate 131 is supported by two pairs of assemblies, each comprising a post 138, a pin 139 and a compression spring 140 equivalent to post 59, pin 61 and compression spring 62 of FIG. 7.

It will be understood that the top and bottom die assemblies 112 and 113, as thus far described, will function in exactly the same way described with respect to the embodiment of FIGS. 4 through 9, the only difference being the manner in which the spring-loaded stripper 118 is mounted.

As indicated above, the edges of the workpiece to be folded may be coated with a heat-reactive adhesive to maintain them permanently folded. The die assemblies of the present invention may be used to apply heat to the workpiece to activate such an adhesive. To this end, that portion of support plate 114 of top die assembly 112 which underlies the radiused folding plate 126 can have a groove 141 formed therein. The groove is adapted to receive a conventional heating element 142 which will be in contact with the radiused folding plate 126 when the radiused folding plate is mounted on support plate 114. Alternatively, the groove 141 could be formed in the radiused folding plate 126 with heating element 142 located therein. When the die assemblies complete the 180° fold in the workpiece, as described with respect to FIGS. 7 through 9, and while the radiused folding plate 126 is still in contact with the folded edges of the workpiece, the heat applied to the radiused folding plate by heating element 142 will cause the heat-activated adhesive to bond the folded edges in their folded positions. It will be understood that any of the embodiments of the top and bottom die assemblies of the present invention can be provided with a heating element for their radiused folding plates equivalent to the heating element 142 of FIG. 16.

It is sometimes desired to provide a folded workpiece with a lining the type which overlies the folded edges of the workpiece. This may be accomplished with any of the top and bottom die assemblies of the present invention. Under such circumstances, the workpiece blank is properly located on the bottom die assembly and the top and bottom die assemblies are caused to fold its edges in any of the ways thus far described. Once the workpiece has had its edges folded, the bottom die assembly is shifted to its forwardmost loading and unloading position. A lining having a peripheral size and configuration equivalent to the folded workpiece, is located on top of the workpiece and the bottom die assembly is returned to its in-press, working position. This is illustrated in FIG. 19 wherein a folding workpiece 148 is shown supported by male plug 129 with a lining 148*a* located on the folded workpiece. The press is cycled a second time. While no folding takes place during this second cycle, when the radiused folding plate engages the edges of the lining on top of the folded edges of the workpiece, heating element 142 of FIG. 16 will cause heat-activated adhesive applied to the lining edges to adhere the lining to the folded edges of the workpiece. Upon completion of this second cycle, the bottom die assembly is returned to its forwardmost position and the completed workpiece with the lining affixed thereto is removed.

When it is intended to use the die assemblies of the present invention to apply a lining of the type just described, it is desirable that the male plug 54 of the embodiment of FIGS. 4 through 9 or the male plug 129 of the embodiment of FIGS. 16 through 18 have its upper surface located slightly below the upper surface of its respective cavity plate 45 or 131 by a distance slightly greater than the thickness of the folded workpiece and the lining, when the bottom die assemblies are in their normal, at-rest conditions. This can be accomplished by providing pins 50 (in the embodiment of FIGS. 4 through 9) or pins 136 (in the embodiment of FIGS. 16 through 18) of the proper length. A simpler procedure, however, is to simply locate a spacing washer between the heads of the pins just mentioned and their respective posts 48 or 135, the spacing washer being of a thickness slightly greater than the combined thickness of the workpiece and the lining. FIG. 20 illustrates such a spacing washer 136*a* mounted on one of pins 136 of the embodiment of FIGS. 16 through 18. Removal of such spacing washers will enable these bottom die assemblies to be used in instances where no such liner is to be applied.

The same is true of the plug-type die of FIGS. 10 through 15. In this instance, when a lining of the type just described is to be applied to the workpiece, it is desirable that the cavity plate 89 has its upper surface slightly below the upper surface of male plug 96, when the bottom die is in its at-rest, normal condition. To accomplish this, it is only necessary to locate spacing washers (similar to spacing washer 136*a* of FIG. 20) between the heads of pins 102 and the bottom ends of posts 101.

There are some instances wherein, as the final 180° fold is made in the workpiece, it is desirable to shift the stripper out of contact with the workpiece. It has been found, for example, that when the edges of the workpiece are to be heat sealed by the die assemblies, if the stripper remains in contact with the workpiece during the heat sealing procedure, it will leave unsightly marks on the back of the workpiece. The stripper will similarly produce unsightly marks on the back of a lining which is being heat sealed to the folded edges of a workpiece.

Another instance wherein removal of the stripper from contact with the workpiece during the final folding procedure is desirable, occurs whend the workpiece is relatively narrow and the folded edges either abut each other or are spaced from each other by a distance less than the thickness of the stripper. Under these circumstances, if the stripper remained in contact with the workpiece during the final 180° fold, the stripper would interfere with the fold and damage the folded edges of the workpiece.

Any of the top and bottom die assemblies of the present invention may be provided with means to disengage the stripper from contact with the workpiece during the final folding procedure so long as the top die assembly has a stripper of the type which is mounted on a floating plate as illustrated and described with respect to FIG. 16. The means for disengaging the stripper from the workpiece during the folding procedure is built right into the top and bottom die assemblies of the present invention, thus obviating the necessity for additional cylinder means on the press to separately control the top die floating plate carrying the stripper as taught in the above mentioned U.S. Pat. No. 4,051,569.

Reference is now made to FIG. 16 wherein such a means is illustrated. The means comprises a plurality of pins affixed to the underside of floating plate 120 and being of a length approximately that of the stripper 118. One such pin is illustrated in FIGS. 16 through 18 at 143. The pin 143 passes through a clearance hole 144 in the support plate 114. The number of pins 143 applied to the underside of the floating plate 120 is simply a matter of that many required to adequately lift the floating plate 120 and to properly balance the die assemblies. In similar, fashion, a second series of pins is attached to the bottom die assembly base plate 127. On such pin is shown at 145. The number of pins 145 will equal the number of pins 143 and the pins 143 and 145 will be arranged in cooperating, coaxial pairs. The pin 145 passes through a clearance hole 146 in the bottom die assembly floating plate 128 and a clearance hole 147 in cavity plate 131.

In FIG. 16, the die assemblies 112 and 113 are shown in their normal, at-rest positions. A workpiece 148 is illustrated as being mounted on cavity plate 113 and male plug 129 between gauges 133 and 134.

As the press is cycled and the top platen 10 with the top die assembly 112 affixed thereto moves downwardly, the stripper 118 will first contact the workpiece 148 and will thereafter shove it downwardly into female cavity 132. This will cause the male plug 129 and the floating plate 128 it is located on to shift downwardly toward the bottom die assembly base plate 127. This downward motion of the male plug 129 and its floating plate 128 will continue until the free end of pin 143 abuts the free end of pin 145. FIG. 17 illustrates the top and bottom die assemblies 112 and 113 at this point. It will be noted, however, that floating plate 128 supporting male plug 129 has not yet bottomed against the bottom die assembly base plate 127. However, the radiused folding plate 126 has contacted the upper surface of female cavity plate 131.

At the top platen 10 and top die assembly 112 continue their downward movement, stripper 118 and its floating plate 120 will remain stationary by virtue of the abutment of pins 143 and 145. The radiused folding plate 126, in contact with the upper surface of cavity plate 131, will cause cavity plate 131 to shift downwardly. As cavity plate 131 shifts downwardly, the partially folded edges of workpiece 148 will ultimately contact the radiused folding plate 126 and will begin to bend inwardly to complete the 180° fold. Force of the radiused cavity plate, acting through the workpiece, will ultimately shove the male plug 129 and its floating plate 128 downwardly until the floating plate 128 abuts the bottom die assembly base plate 127. This is illustrated in FIG. 18. Once the male plug 129 and its floating plate 128 begin this last increment of downward travel, the end of stripper 118 will lose contact with the workpiece since downward movement of stripper 118 and its floating plate 120 had been stopped by the cooperation of pins 143 and 145. The last increment of folding of the workpiece edges will be made free of the stripper 118. It will be noted from FIG. 18 that the folded edges of workpiece 148 are spaced from each other by a distance less than the thickness or width of stripper 118. As the cycle is completed and the top and bottom die assemblies 112 and 113 return to their normal conditions, the folded edges will br briefly contacted by the stripper, assuring that they are fully seated in their folded position.

It will further be understood by one skilled in the art that if the press were recycled with a lining overlying the folded edges of the workpiece and the press were recycled to the point illustrated in FIG. 18, the stripper 118 would be out of contact with the lining and would not make unsightly marks on the lining as the lining is heated by the heating element 142. Even in the absence of a lining, the stripper 118 would not create unsightly marks on the back of the workpiece 148 if its edges were adhered in their folded condition by the heating element 142.

The cavity die of FIGS. 4 through 9 and the plug die of FIGS. 10 through 15 could be provided with pins equivalent to pins 143 and 145 of FIGS. 16 through 18 so long as their respective strippers were mounted by means of a floating plate of the type shown at 120 in FIGS. 16 through 18. It will be understood that the pins 143 and 145 could be replaced by a single pin mounted on the bottom die assembly base plate and having a length equivalent to the combined lengths of pins 143 and 145. Pins such as pins 143 and 145 could also be applied to prior art die assemblies, of the type described above, to accomplish the same purpose.

All parts of the top and bottom die assemblies of the present invention could be made of steel or the like. To reduce the weight of the die assemblies, all parts thereof could be made of a sufficiently rigid plastic material, with the exception of the posts, pins and compression springs. Excellent results have been achieved utilizing top and bottom die assemblies wherein the posts, pins, compression springs and radiused folding plates are made of steel, the remainder of the assemblies being made of aluminum.

Modification may be made in the invention without departing from the spirit of it.

What we claim is:

1. Cooperating top and bottom die assemblies for mounting on the top and bottom platens of a press to fold the edges of a non-rigid workpiece, said top die assembly comprising a horizontal support plate, a radiused folding plate being affixed to the underside of said support plate, a spring biased stripper in association with said support plate, said stripper being shiftable vertically with respect to said support plate between a retracted position and a normal position below said radiused folding plate to which it is biased, a plurality of support posts mounted on said support plate and extending upwardly from the upper surface thereof, means to affix said top die assembly to said top press platen with the upper ends of said support posts abutting said top platen, said bottom die assembly comprising a horizontal base plate adapted to rest on said bottom press platen, a first set of downwardly depending hollow posts with closed bottom ends being mounted on the underside of said base plate to either side of said bottom platen, pins and surrounding compression springs being telescopically mounted in said posts, each of said pins passing upwardly through a perforation in the closed end of its respective post and having a head portion located beneath its respective post, a horizontal floating plate being located above said base plate and mounted on the upper ends of said pins so as to be shiftable by said top die assembly between a normal position to which it is biased by said compression springs and which is determined by the abutment of said head portions of said pins against said bottom closed ends of their respective posts and a depressed position in abutment with the upper surface of said base plate, a male plug mounted on the upper surface of said floating plate, a second set of downwardly depending hollow posts with closed bottom ends being mounted on said underside of said base plate to either side of said bottom platen, pins and surrounding compression springs being telescopically mounted in said last mentioned posts, each of said pins passing upwardly through a perforation in the closed end of its respective one of said last mentioned posts and having a head portion located beneath said closed end of its respective post, said floating plate having clearance holes for said last mentioned pins and compression springs, a cavity plate being located above said floating plate and mounted on the upper ends of said last mentioned pins so as to be shiftable by said top die assembly between a normal position to which it is biased by said last mentioned compression springs and which is determined by the abutment of said heads of said last mentioned pins with the closed ends of their respective posts and a depression, said cavity plate having a female cavity formed therein of such size and shape as to receive said male plug therein with close tolerance when said cavity plate and said floating plate are both in their normal positions and both in their depressed positions, the upper surface of said cavity plate and the upper surface of said plug being substantially coplanar when said cavity plate and said bottom die assembly floating plate are in their respective normal positions.

2. The structure claimed in claim 1 wherein said top and bottom die assemblies are of the cavity type, and including gauges mounted on said cavity plate to properly located said workpiece thereon and on said male plug.

3. The structure claimed in claim 1 wherein said top and bottom die assemblies are of the plug type, and including gauges mounted on said male plug to properly locate said workpiece thereon and on said cavity plate.

4. The structure claimed in claim 1 wherein said stripper has a plurality of upstanding pins mounted on its upper surface, said upstanding support posts on said support plate being hollow with closed upper ends and open lower ends which extend through said support plate, said pins on said stripper each extending telescopically into one of said support posts, each of said pins being surround by a compression spring abutting said upper surface of said stripper and said closed upper end of its respective posts so as to urge said stripper to said normal position, additional headed pin means attached to said upper surface of said stripper and extending through clearance holes in said support plate with their heads above said support plate and abutting the upper surface of said support plate when said stripper is in said normal position to thereby determine said normal position of said stripper.

5. The structure claimed in claim 1 including a floating plate for said top die assembly, said floating plate being located above said support plate and having clearance holes through which said support posts extend, said stripper extending through an opening in said support plate with its upper end being affixed to said floating plate, selected ones of said support posts having cap-like spring retainers affixed to their upper ends, a compression spring surrounding each of said selected support posts with the upper end of said compression spring abutting said spring retainer of its respective support post and the lower end of said compression spring abutting the upper surface of said floating plate of said top die assembly biasing said floating plate into abutment with said support plate to determine said normal position of said stripper.

6. The structure claimed in claim 1 including a groove formed in one of said support plate and said radiused folding plate and a heating element located in said groove and being in contact with said radiused folding plate to impart heat to said radiused folding plate.

7. The structure claimed in claim 1 wherein said means to affix said top die assembly to said top platen comprises a dovetailed gib mounted on the upper ends of at least a pair of said support posts, said gib being configured to extend into a corresponding dovetailed slot in said top platen, two of said support posts having open upper ends and being positioned near the forward corners of said support plate whereby to receive set screws mounted in said top platen to prevent shifting of said top die assembly with respect to said top platen.

8. The structure claimed in claim 1 including stop means for stripper whereby downward movement of said stripper is stopped during the final portion of the folding of said workpiece by said top and bottom die assemblies to preclude contact between stripper and said workpiece during said final portion of said folding.

9. The structure claimed in claim 2 including means to maintain the upper surface of said male plug at a level below the upper surface of said cavity plate when said floating plate of said bottom die assembly and said cavity plate are in their normal positions, whereby said top and bottom die assemblies can be used to apply a lining to a folded workpiece.

10. The structure claimed in claim 2 including a floating plate for said top die assembly, said floating plate being located above said support plate and having clearance holes through which said support posts extend, said stripper extending through an opening in said support plate with its upper end being affixed to said floating plate, selected ones of said support posts having cap-like spring retainers affixed to their upper ends, a compression spring surrounding each of said selected support posts with the upper end of said compression spring abutting said spring retainer of its respective support post and the lower end of said compression spring abutting the upper surface of said floating plate of said top die assembly biasing said floating plate into abutment with said support plate to determine said normal position of said stripper.

11. The structure claimed in claim 3 including means to maintain the upper surface of said female cavity plate at a level below the upper surface of said male plug when said floating plate of said bottom die assembly and said cavity plate are in their normal positions whereby said top and bottom die assemblies can be used to apply a lining to a folded workpiece.

12. The structure claimed in claim 3 including a floating plate for said top die assembly, said floating plate being located above said support plate and having clearance holes through which said support posts extend, said stripper extending through an opening in said support plate with its upper end being affixed to said floating plate, selected ones of said support posts having cap-like spring retainers affixed to their upper ends, a compression spring surrounding each of said selected support posts with the upper end of said compression spring abutting said spring retainer of its respective support post and the lower end of said compression spring abutting the upper surface of said floating plate of said top die assembly biasing said floating plate into abutment with said support plate to determine said normal position of said stripper.

13. The structure claimed in claim 5 including stop means for said stripper, said stop means comprising a plurality of pairs of cooperating, vertical, coaxial stop posts, one stop post of each pair being mounted at its upper end to the underside of said top die assembly floating plate and extending downwardly through a clearance hole in said support plate, the other stop post of each pair being mounted at its lower end to said base plate of said bottom die assembly and extending upwardly through clearance holes in said bottom die floating plate and said cavity plate, said stop posts of each pair being of such length as to abut each other and serve as a stop for said top die assembly floating plate and said stripper attached thereto before said bottom die assembly floating plate and cavity plate reach their respective depressed positions whereby said stripper is out of contact with said workpiece during the final portion of the folding thereof.

14. The structure claimed in claim 5 including stop means for said stripper, said stop means comprising a plurality of identical vertical stop posts mounted at their bottom ends to said base plate of said bottom die assembly, said floating plate and said cavity plate of said bottom die assembly and said support plate of said top die assembly having clearance holes therethrough for said stop posts, said stop posts being of such length as to abut said top die assembly floating plate and serve as stops therefor and for said stripper attached thereto before said bottom die assembly floating plate and cavity plate reach their respective depressed positions whereby said stripper is out of contact with said workpiece during the final portion of the folding thereof.

15. The structure claimed in claim 9 wherein said means to maintain the upper surface of said male plug at a level below the upper surface of said cavity plate comprise spacer washers mounted on said pins supporting said bottom die floating plate between the head portions thereof and the closed bottom ends of their respective posts.

16. The structure claimed in claim 10 including stop means for said stripper whereby downward movement of said stripper is stopped during the final portion of the folding of said workpiece by said top and bottom die assemblies to preclude contact between said stripper and said workpiece during said final portion of said folding.

17. The structure claimed in claim 11 wherein said means to maintain the upper surface of said female cavity plate at a level below the upper surface of said male plug comprise spacer washers mounted on said pins supporting said bottom die cavity plate between the head portions thereof and the closed bottom ends of their respective posts.

18. The structure claimed in claim 12 including stop means for said stripper whereby downward movement of said stripper is stopped during the final portion of the folding of said workpiece by said top and bottom die assemblies to preclude contact between said stripper and said workpiece during said final portion of said folding.

19. The structure claimed in claim 16 including a groove formed in one of said support plate and said radiused folding plate and a heating element located in said groove and being in contact with said radiused folding plate to impart heat to said radiused folding plate.

20. The structure claimed in claim 18 including a groove formed in one of said support plate and said radiused folding plate and a heating element located in said groove and being in contact with said radiused folding plate to impart heat to said radiused folding plate.

21. The structure claimed in claim 19 including means to maintain the upper surface of said male plug at a level below the upper surface of said cavity plate when said floating plate of said bottom die assembly and said cavity plate are in their normal positions, whereby said top and bottom die assemblies can be used to apply a lining to a folded workpiece.

22. The structure claimed in claim 20 including means to maintain the upper surface of said female cavity plate at a level below the upper surface of said male plug when said floating plate of said bottom die assembly and said cavity plate are in their normal positions whereby said top bottom die assemblies can be used to apply a lining to a folded workpiece.

23. The structure claimed in claim 16 wherein said stop means for said stripper comprises a plurality of pairs of cooperating, vertical, coaxial stop posts, one stop post of each pair being mounted at its upper end to the underside of said top die assembly floating plate and extending downwardly through a clearance hole in said support plate, the other stop post of each pair being mounted at its lower end to said base plate of said bottom die assembly and extending upwardly through clearance holes in said bottom die floating plate and said cavity plate, said stop posts of each pair being of such length as to abut each other and serve as a stop for said top die assembly floating plate and said stripper attached thereto before said bottom die assembly floating plate and cavity plate reach their respective depressed positions whereby said stripper is out of contact with said workpiece during the final portion of the folding thereof.

24. The structure claimed in claim 16 wherein said stop means for said stripper comprises a plurality of identical vertical stop posts mounted at their bottom ends to said base plate of said bottom die assembly, said floating plate and said cavity plate of said bottom die assembly and said support plate of said top die assembly having clearance holes therethrough for said stop posts, said stop posts being of such length as to abut said top die assembly floating plate and serve as stops therefor and for said stripper attached thereto before said bottom die assembly floating plate and cavity plate reach their respective depressed positions whereby said stripper is out of contact with said workpiece during the final portion of the folding thereof.

25. The structure claimed in claim 18 wherein said stop means for said stripper comprises a plurality of pairs of cooperating, vertical, coaxial stop posts, one stop post of each pair being mounted at its upper end to the underside of said top die assembly floating plate and extending downwardly through a clearance hole in said support plate, the other stop post of each pair being mounted at its lower end to said base plate of said bottom die assembly and extending upwardly through clearance holes in said bottom die floating plate and said cavity plate, said stop posts of each pair being of such length as to abut each other and serve as a stop for said top die assembly floating plate and said stripper attached thereto before said bottom die assembly floating plate and cavity plate reach their respective depressed positions whereby said stripper is out of contact with said workpiece during the final portion of the folding thereof.

26. The structure claimed in claim 18 wherein said stop means for said stripper comprises a plurality of identical vertical stop posts mounted at their bottom ends to said base plate of said bottom die assembly, said floating plate and said cavity plate of said bottom die assembly and said support plate of said top die assembly having clearance holes therethrough for said stop posts, said stop posts being of such length as to abut said top die assembly floating plate and serve as stops therefor and for said stripper attached thereto before said bottom die assembly floating plate and cavity plate reach their respective depressed positions whereby said stripper is out of contact with said workpiece during the final portion of the folding thereof.

27. The structure claimed in claim 21 wherein said means to maintain the upper surface of said male plug at a level below the upper surface of said cavity plate comprise spacer washers mounted on said pins supporting said bottom die floating plate between the head portions thereof and the closed bottom ends of their respective posts.

28. The structure claimed in claim 22 wherein said means to maintain the upper surface of said female cavity plate at a level below the upper surface of said male plug comprise spacer washers mounted on said pins supporting said bottom die cavity plate between the head portions thereof and the closed bottom ends of their respective posts.

29. Cooperating top and bottom die assemblies for mounting on the top and bottom platens of a press to fold the edges of a non-rigid workpiece, said top die assembly comprising a horizontal support plate, a radiused folding plate being affixed to the underside of said support plate, a horizontal floating plate above and in association with said support plate and being shiftable vertically with respect to said support plate between a retracted position and a normal position in abutment with said support plate, means to bias said floating plate to said normal position, a stripper located beneath said support plate, means for mounting said stripper to said top die assembly floating plate through at least one perforation in said support plate so as to be shiftable with said floating plate relative to said support plate between a retracted position and a normal position wherein said stripper extends below said radiused folding plate, said biasing means for said top die assembly floating plate simultaneously biasing said stripper to its normal position, means to mount said top die assembly to said top press platen, said bottom die assembly comprising a horizontal base plate adapted to rest on said bottom press platen, a bottom die assembly floating plate located above said base plate, means in association with said base plate to support said bottom die assembly floating plate so as to be shiftable by said top die assembly between a normal position and a depressed position in abutment with said base plate, means to bias said bottom die assembly floating plate to said normal position, a male plug mounted on the upper surface of said bottom die assembly floating plate, a cavity plate located above said bottom die assembly floating plate, means in association with said base plate to support said cavity plate so as to be shiftable by said top die assembly between a normal position and a depressed position, means to bias said cavity plate to said normal position, said cavity plate having a female cavity therein so shaped and dimensioned as to receive said male plug with close tolerance, the upper surface of said cavity plate and the upper surface of said plug being substantially co-planar when said cavity plate and said bottom die assembly floating plate are in their respective normal positions, and stop means for said stripper whereby downwardly movement of said stripper is stopped during the final portion of the folding of said workpiece by said top and bottom die assemblies to preclude contact between said stripper and said workpiece during said final portion of said folding.

30. The structure claimed in claim 29 wherein said top and bottom die assemblies are of the cavity type, gauges mounted on said cavity plate to properly locate said workpiece thereon and on said male plug.

31. The structure claimed in claim 29 wherein said top and bottom die assemblies are of the plug type, gauges mounted on said male plug to properly locate said workpiece thereon and on said cavity plate.

32. The structure claimed in claim 29 including a groove formed in one of said support plate and said radiused folding plate and a heating element located in said groove and being in contact with said radiused folding plate to impart heat to said radiused folding plate.

33. The structure claimed in claim 29 wherein said stop means for said stripper comprises a plurality of pairs of cooperating, vertical, coaxial stop posts, one stop post of each pair being mounted at its upper end to the underside of said top die assembly floating plate and extending downwardly through a clearance hole in said support plate, the other stop post of each pair being mounted at its lower end to said base plate of said bottom die assembly and extending upwardly through clearance holes in said bottom die floating plate and said cavity plate, said stop posts of each pair being of such length as to abut each other and serve as a stop for said top die assembly floating plate and said stripper attached thereto before said bottom die assembly floating plate and cavity plate reach their respective depressed positions whereby said stripper is out of contact with said workpiece during the final portion of the folding thereof.

34. The structure claimed in claim 29 wherein said stop means for said stripper comprises a plurality of identical vertical stop posts mounted at their bottom ends to said base plate of said bottom die assembly, said floating plate and said cavity plate of said bottom die assembly and said support plate of said top die assembly having clearance holes therethrough for said stop posts, said stop posts being of such length as to abut said top die assembly floating plate and serve as stops thereof and for said stripper attached thereto before said bottom die assembly floating plate and cavity plate reach their respective depressed positions whereby said stripper is out of contact with said workpiece during the final portion of the folding thereof.

35. The structure claimed in claim 30 including means to maintain the upper surface of said male plug at a level below the upper surface of said cavity plate when said floating plate of said bottom die assembly and said cavity plate are in their normal positions, whereby said top and bottom die assemblies can be used to apply a lining to a folded workpiece.

36. The structure claimed in claim 35 including means to maintain the upper surface of said female cavity plate at a level below the upper surface of said male plug when said floating plate of said bottom die assembly and said cavity plate are in their normal positions whereby said top and bottom die assemblies can be used to apply a lining to a folded workpiece.

* * * * *